United States Patent [19]

Lekas

[11] 4,294,061

[45] Oct. 13, 1981

[54] COMESTIBLE PACKAGING APPARATUS

[76] Inventor: John P. Lekas, 5316 E. Exeter Blvd., Phoenix, Ariz. 85019

[21] Appl. No.: 942,126

[22] Filed: Sep. 13, 1978

[51] Int. Cl.[3] ..... B65B 35/50

[52] U.S. Cl. ..... 53/536; 53/152; 53/540; 53/250

[58] Field of Search ..... 53/447, 536, 537, 540, 53/245, 152, 250, 247, 251, 248; 414/89

[56] References Cited

U.S. PATENT DOCUMENTS

| | | | |
|---|---|---|---|
| 2,796,179 | 6/1957 | van Vleck | 53/540 X |
| 3,220,158 | 11/1965 | Roser et al. | 53/537 X |
| 3,579,956 | 5/1971 | Hoffmann | 53/540 |
| 3,683,582 | 8/1972 | Seguin | 53/536 X |
| 4,086,745 | 5/1978 | Caudle | 53/532 |

*Primary Examiner*—Horace M. Culver

[57] ABSTRACT

Apparatus is disclosed for automatically stacking a plurality of trays containing comestibles such as fruit or the like into packages such as boxes of the like. Trays are synchronously supplied via an incremental belt to a tray stacking portion, where the trays are nested one atop the next. The stack of nested trays is then deposited on a counter-weighted drop shelf situated within the package. The weight of the trays on the drop shelf overcomes the inertia of the drop shelf and its counterweight such that the stack of trays are smoothly lowered into the package or carton. The tray stacking portion is adjustable to permit automatic packaging of different size fruit.

5 Claims, 19 Drawing Figures

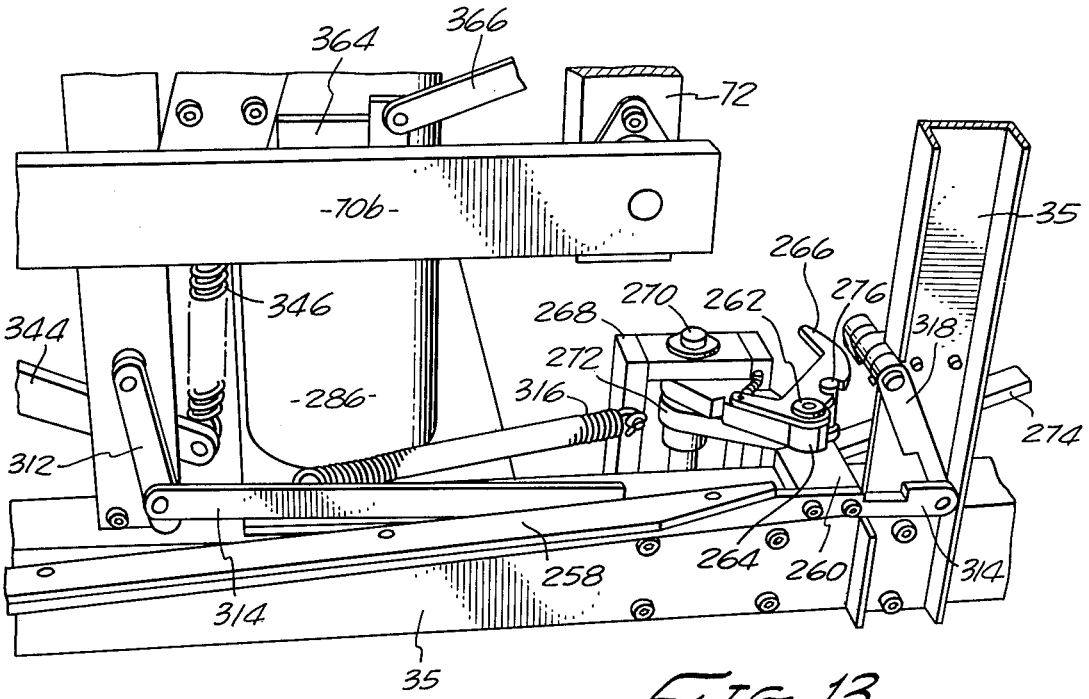
FIG. 13.
FIG. 14.
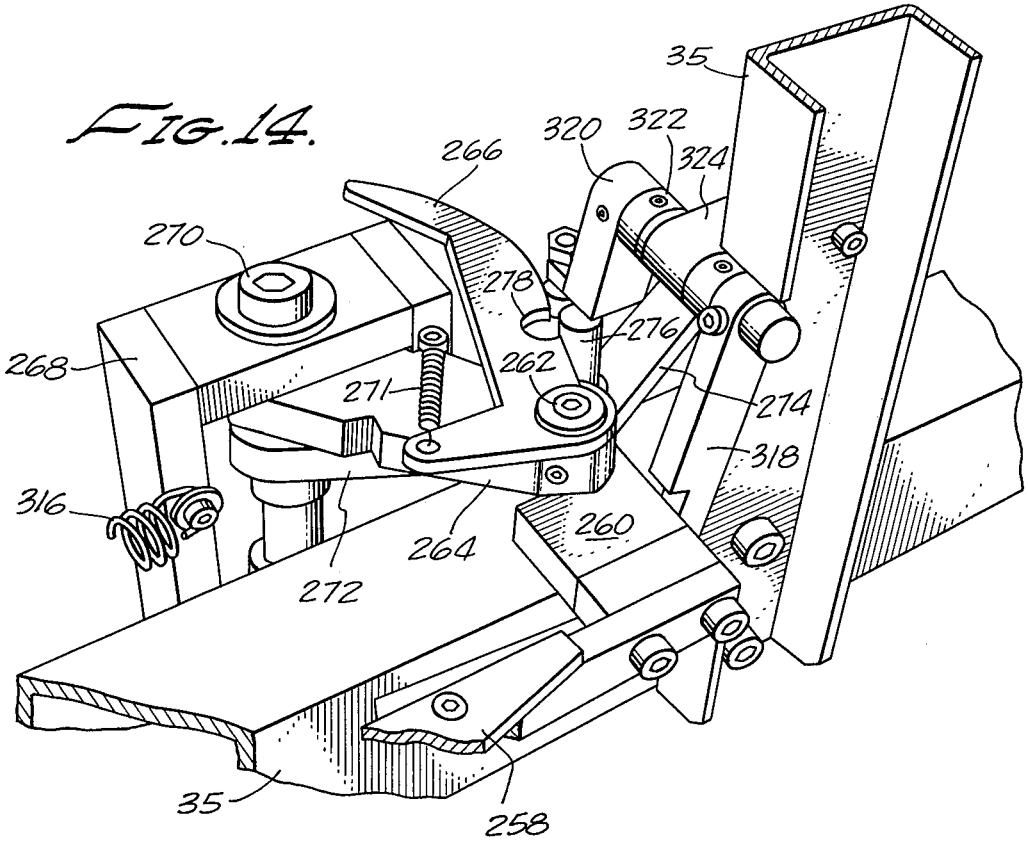

COMESTIBLE PACKAGING APPARATUS

BACKGROUND OF THE INVENTION

The present invention relates generally to packaging devices, and more particularly to comestible packaging devices.

It has long been recognized that packaging of comestibles must be highly automated to be economically feasible, since the costs of manual labor have climbed skyward in recent years. Thus, several devices have been devices for automatic packaging of comestibles; see for example Ehe et al U.S. Pat. No. 3,389,531, Wahle U.S. Pat. No. 3,499,555, Voullaire U.S. Pat. No. 3,613,330.

Likewise, it is known that packing the fruit into trays is helpful in protecting the goods, see Stuart U.S. Pat. No. 2,833,095. Also, Sandmeyer U.S. Pat. No. 2,893,550 teaches that the pockets in alternate trays may be arranged so that the trays may be "nested", or closely stacked atop one another for subsequent packing into cartons.

Although the foregoing patents teach means by which packing, and in some cases automatic packing, can be expedited, none of these disclosures provides means for actually placing trays or stacks of trays into cartons, a necessary step in preparing the fruit for shipment. Holmes U.S. Pat. No. 2,968,899 discloses a means for placing the trays in stacks using a spring-loaded discharge conveyor which is positioned vertically be means of a post having vertically spaced collars. However, no means is disclosed for placing the tray stack into a carton. Johnson et al U.S. Pat. No. 3,324,623 discloses a means for packing citrus fruit into cartons without first placing the fruit in trays. An empty carton is placed on a shelf supported by a post, the post having therein several notches. As each layer of fruit is deposited in the carton, a star wheel arrangement permits the post and its associated shelf to be lowered by one notch, until after several steps the carton is full. However, bruising of the fruit is likely to occur since the fruit is deposited directly onto the next lower layer.

While the Holmes and Johnson disclosures provide rudimentary means for packing fruit into cartons, neither provides a means for packing trays of fruit into cartons in a manner which ensures that the fruit is rapidly but safely and securely packed into cartons for shipping.

SUMMARY OF THE INVENTION

The present invention provides a means for rapidly loading a plurality of trays containing comestibles such as fruit or the like into a carton or package for subsequent handling and shipment. The trays of fruit are supplied to an incremental belt by any conventional means, and the incremental belt then supplies the trays to a shelf assembly by means of a feed comb which purhes the trays onto the shelves. The movement of the incremental belt is synchronized with both the feed comb and the shelf assembly to permit rapid but smooth movement of the fruit-laden trays from the incremental belt to the shelves.

The number of shelves in the shelf assembly corresponds to the maximum number of trays to be packed in a carton, and the first tray loaded into the shelf assembly is loaded onto the bottom shelf and becomes the bottom tray in, as will be apparent shortly, a nested stack. When the first tray is pushed off the incremental belt onto the bottom tray of the shelf assembly, the bottom shelf locks into position. Once the first tray has been placed on the shelf, the entire shelf assembly is lowered by the height of one tray. Thereafter a second shelf is placed above the first tray, and a second tray is pushed from the incremental belt onto the second shelf by the feed comb.

Once the feed comb has pushed the second tray onto the second shelf and retracted, that shelf also retracts into the shelf assembly. This causes the second tray to "nest" or stack atop the first tray. Again, once the second tray has been deposited atop the first, the entire shelf assembly is lowered to accept another tray, and the process is repeated. Eventually a stack of nested trays rests on the bottom, or first, shelf.

Once the trays have been stacked in accordance with the above, the shelf assembly is returned to its original height and the counterweighted drop shelf assembly is placed beneath the tray stack. The bottom shelf is then removed from beneath the stack, and the stack is therefore deposited on the drop shelf. The counterweighting of the drop shelf is selected to permit the weight of the tray stack to overcome the inertia of the counterweight and drop shelf, thus lowering the tray stack into the carton smoothly but rapidly. The filled carton may then be removed for further handling.

It is therefore one object of the present invention to provide an improved comestible packing apparatus.

Another object of the present invention is to provide an automatic packaging device for citrus fruit or the like.

A further object of the present invention is to provide an apparatus for automatically packaging trays of fruit in cartons.

Still another object of the present invention is to provide an apparatus which synchronously stacks a plurality of trays of fruit and places the stacks in cartons.

The foregoing and other objects of the invention will be better understood from the following detailed description of the invention taken together with the attached Figures, in which FIGS. 1*a* and 1*b* are plan and elevational side views, respectively, of an apparatus according to the present invention.

FIGS. 13 and 14 are detail views of the crescent latch portion of the apparatus.

DETAILED DESCRIPTION OF THE INVENTION

Figure 1A:
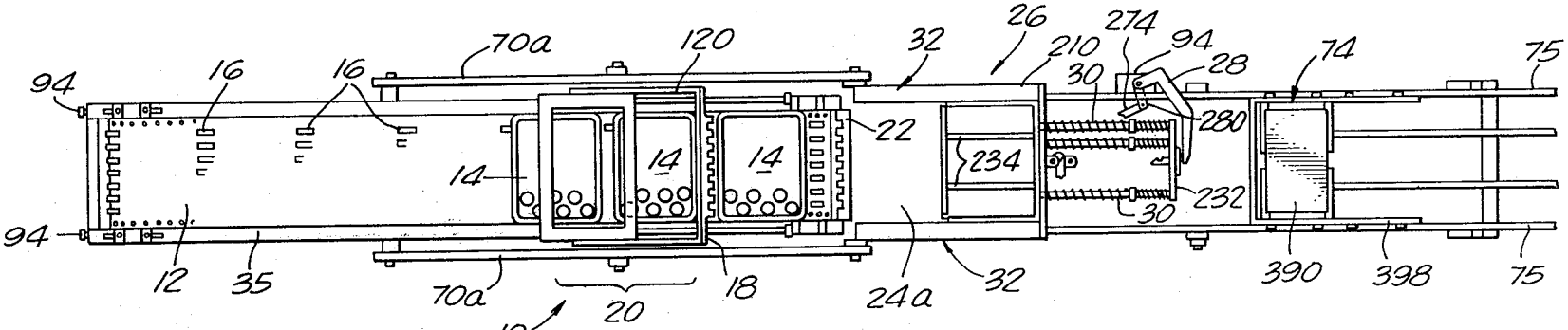
Figure 1B:
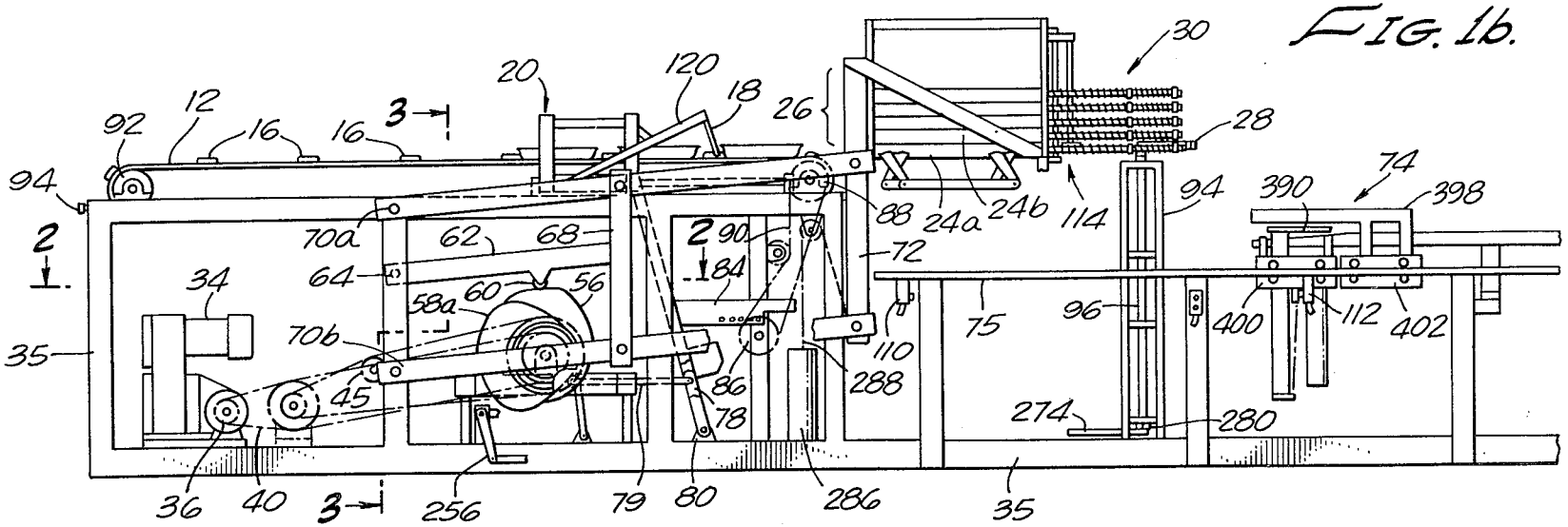

Referring first to FIGS. 1*a* and 1*b*, in which one embodiment of a packing apparatus according to the present invention is indicated generally at 10, an incremental belt 12 receives trays 14 of comestibles such fruit, for example tangerines, from any suitable device. One such device is disclosed in U.S. Pat. No. 3,765,149. The trays 14 are delivered onto the belt 12 between rows of double-toed cleats 16, which are spaced along the belt slightly more than a tray's width apart. Each tray is carried forward incrementally along the belt 12, in a manner discussed in detail hereinafter, until it reaches a feed comb 18.

The feed comb 18 is part of a feed comb assembly indicated generally at 20 in FIG. 1*b*, and pushes the trays 14 across a jump-off platform 22 (FIG. 1*a*) and onto an extended shelf 24*a*. The shelf 24*a* is one of a plurality of shelves in a shelf assembly indicated generally at 26. The shelf 24*a* is pushed forward into the extended position (to receive a tray 14) by a reset arm 28 through a pair of spring-loaded rods 30 and is guided by a pair of rails 32.

Also shown in FIG. 1*b* is the main drive assembly for the described embodiment of the present invention. The drive is powered by an electric motor 34, which may for example be a Dayton one horsepower, three phase adjustable speed motor with gear reduction. The motor 34 is mounted on a frame 35, which supports the various subassemblies that comprise the present invention. The gear reduction terminates in a sprocket 36 which drives a sprocket 38 via a chain 40, better shown in FIG. 2. The sprocket 38 is preferably commonly mounted on a shaft 42 with a trio of sprockets 44*a–c* so that rotation of the sprocket 38 turns the sprockets 44*a–c*. The sprocket 36 may have fourteen teeth, and the sprocket 44*b* nine teeth, whereas the sprockets 38, 44*a* and 44*c* have forty-two teeth; however, the number of teeth for a particular sprocket is not critical and may be varied over a wide range, provided the respective shaft speed ratios remain the same, or other suitable ratios are used.

The sprocket 44*a–c* in turn drive sprockets 46*a*, 46*b* and 46*c*, respectively, via chains 48*a–c*. An idler sprocket 45 may be provided between the sprockets 44*b* and 46*b*. The sprockets 46*a–c* are mounted on a shaft 50 but the sprockets 46*a* and 46*c* are journaled independently so that each may turn at different speeds. The sprocket 46*a* may have forty-two teeth, the sprocket 46*b* fifty-four teeth, and the sprocket 46*c* thirty-six teeth. The sprocket 46*a* is fixedly connected to a four-tray feed cam 52*a* and the sprocket 46*b* is fixedly connected to a four-tray main cam 54 as well as a five-tray main cam 56. The sprocket 46*c* is fixedly connected to a five-tray feed cam 58*a*. It can thus be seen that the feed cam 58*a* turns seven times for each revolution of the main cam 56, while the feed cam 52*a* turns six times for each revolution of the main cam 54. Integrally formed with each feed cam 52*a* and 58*a* are face cams 52*b* and 58*b*, respectively. The purposes of each of the above-described cams will become clear hereinafter. Generally, the cams, together with their respective followers which are described hereinafter, provide synchronous operation of the above-described incremental belt, feed comb, and shelf assembly, thereby permitting reliable high speed operation.

The manner by which such synchronous operation is provided may be seen generally from FIG. 1*b*, which illustrates the basic connection of the motor 34 to the sprockets 44*a–c* and thence to the sprockets 46*a–c* and the various cams. Particularly, FIG. 1*b* shows the five tray feed cam 58*a* and the five tray main cam 56, which will be discussed as exemplary hereinafter.

A main cam follower 60, rotatably mounted on a main cam arm 62, continuously engages the main cam 56. The main cam arm 62 is pivotably supported at its left end (FIG. 1*b*) by a shaft and pillow block assembly 64, shown in greater detail in FIG. 2. The main cam follower 60 thus moves through fixed excursions determined by the main cam 56. The main cam arm 62 is indirectly connected at its other end to a stacker lifter cross member 66 (better seen in FIG. 2) which extends transversely across the frame of the apparatus and connects at each end to a pair of vertical stacker lift arms 68 (only one shown in FIG. 1*b*). The lift arms 68 in turn each pivotably connect at each end thereof to the center of a pair of lift members 70*a* and 70*b*. The lift members 70*a* are pivotably connected to a vertical member of the frame 35 at their left end (FIG. 1*b*) and also pivotably connected to another vertical member 72 at their right end. The vertical member 72 directly connects to the shelf assembly 26.

From the above it can be seen that the main cam 56 causes the shelf assembly 26 to move through a series of downward incremental excursions. Although the magnitude of the excursion can be adjusted to accommodate various shelf heights in a manner discussed in detail hereinafter, the lobes of the main cam 56 cause the shelf assembly 26 to rise to its highest point (shown in FIG. 1*b*) so that the first, or lowest, shelf 24*a* is aligned with the jump off platform 22, where a dewll on the cam 56 maintains the position of the shelf assembly while the feed comb 18 pushes a tray 14 onto the extended shelf 24*a* in a manner better described hereinafter. The main cam 56 then rotates past the dwell and incrementally lowers the shelf assembly so that the next shelf 24*b* is aligned with the jump off platform 22. The main cam 56 has five dwells of this nature, so that five trays may be stacked in a nested arrangement one atop the next. The trays 14 are supplied to the belt 12 in a manner which permits nesting, such as rotating alternating trays 180° about a horizontal axis.

After the five dwells described above, the main cam is shaped to provide a long rise, which returns the shelf assembly to its topmost position, followed by a long dwell while the nested stack of trays is placed in a carton by a boxer assembly indicated generally at 74 and better described in connection with FIG. 9. The boxer assembly 74 moves into position for receiving a tray stack under the shelf assembly 26 by means of a pair of rails 75, and preferably is synchronous with the remainder of the apparatus. After the tray stack has been deposited in the carton carried on the boxer assembly 74, the assembly 74 returns to the position shown in FIG.

1*b* and the now-filled carton is removed by conventional means for subsequent handling.

As mentioned above, the feed comb 18 pushes tray 14 onto an extended shelf such as the shelf 24*a*. The movement of the feed comb 18 is controlled by the rotation of the feed cam 58*a*, which drives a feed cam follower 76*b* (shown in FIG. 2) and feed cam follower rod 79. The feed cam follower rod 79 indirectly connects to a pair of feed cam follower arms 78 through a primary cage and a secondary cage described in connection with FIG. 6. As the feed cam 58*a* rotates, it drives the follower 76*b* and thus moves the feed cam follower arms 78 in an arcuate motion from left to right (FIG. 1*b*) about their pivot points 80, as can be better appreciated from FIG. 4.

The feed cam follower arms 78 are connected to the feed comb assembly 20 and cause the feed comb 18 to move from left to right (FIG. 1*b*) with the rotation of the feed cam 58*a*. The feed comb 18 is thus able to push the trays 14 carried on the belt 12 over the jump-off platform 22 and onto one of the extended shelves such as the shelf 24*a*. It will be appreciated that the extension of the shelf may be synchronized to occur only moments after main cam 56 aligns a tray with jump off platform 22 simply by disengaging the chains 48*a–c* and slightly adjusting the positions of the feed cams with respect to the main cams.

As noted previously, the incremental belt 12 also moves, in a stepwise manner, synchronously with the movement of the feed comb 18 and shelf assembly 26. The movement of the incremental belt is controlled, in the five tray position, by the face cam 58*b*. A face cam follower 82*b* (shown in FIG. 2), together with the primary and secondary cages mentioned above, controls the rise and fall movement of a belt rack 84, which also moves horizontally in synchronism with the feed cam follower arms 78. On its forward stroke (moving left to right in FIG. 1*b*), the belt rack 84 engages a sprocket 86*a* which rotates a sprocket 86*b* (shown in FIG. 7) mounted on a common shaft 87. The sprocket 86*b* rotates a sprocket 88 via a chain 90.

The sprocket 88 is mounted on a common shaft with a toothed pulley 89, which engages and supports the incremental belt 12, the belt 12 being supported at its other end by another toothed pulley 92. The sprockets 88 and 92 are supported on the frame 35, with a tensioning adjustment 94 being provided to maintain the belt in a taut condition. The rotation of the feed cam 58*a* and its associated face cam 58*b* thus cause the incremental belt 12 to advance synchronously with the feed comb 18, although the feed comb 18 preferably moves slightly faster since it must push a tray 14 off the belt, over the jump-off platform 22 and across the shelf during the same period in which the belt 12 moves the width of one tray.

As noted previously, the shelves of the shelf assembly 26 are pushed into the extended position by a reset arm 28. The reset arm 28 is supported by a reset arm tower 94, and is rigidly affixed to a reset arm shaft 96. Although not entirely shown in FIG. 1*b*, the rotation of the reset arm shaft 96 is controlled by the feed cam 58*a* through a reset arm linkage described in detail in connection with FIGS. 4 and 14. As can be appreciated from FIG. 1*b*, the downward movement of the shelf assembly 26 brings the spring-loaded shelf rods 30 into alignment with the reset arm 28 to cause the associated shelf to be extended to receive a tray at the proper time.

Figure 2:
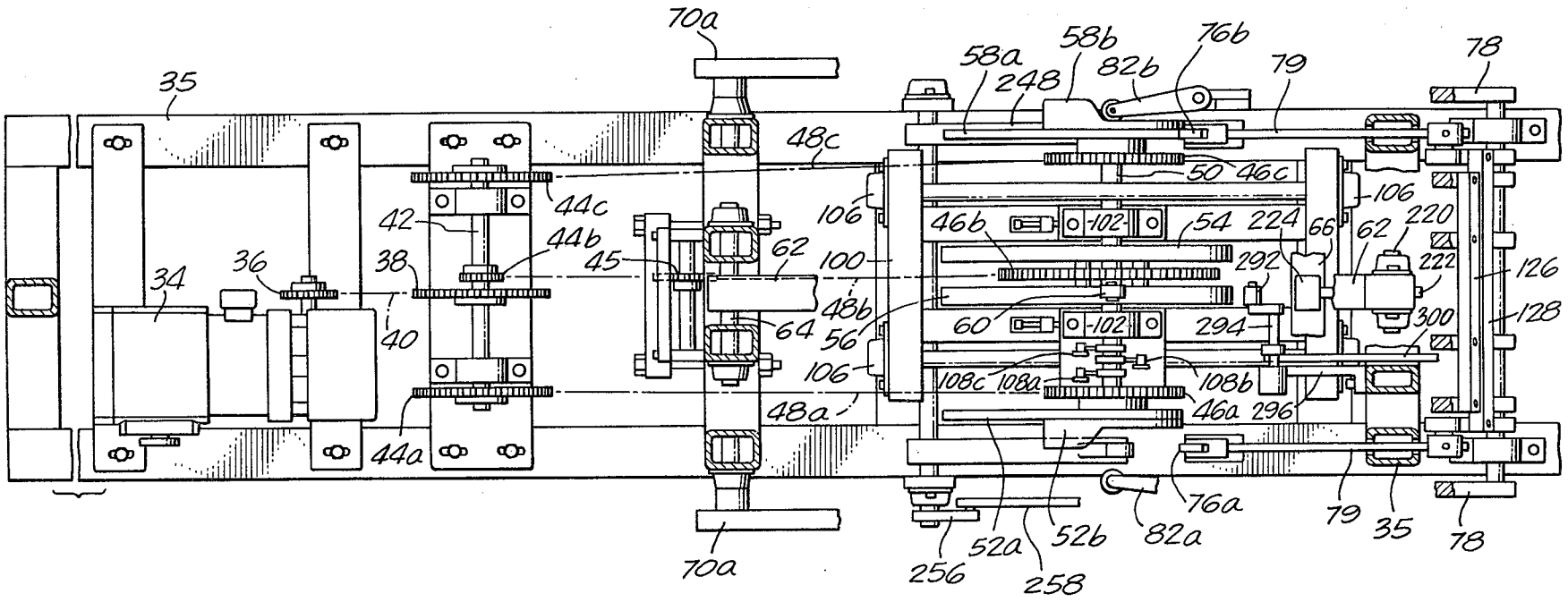
FIG. 2 is sectional plan view taken generally along the lines 2—2 in FIG. 1*b*.
Figure 3:
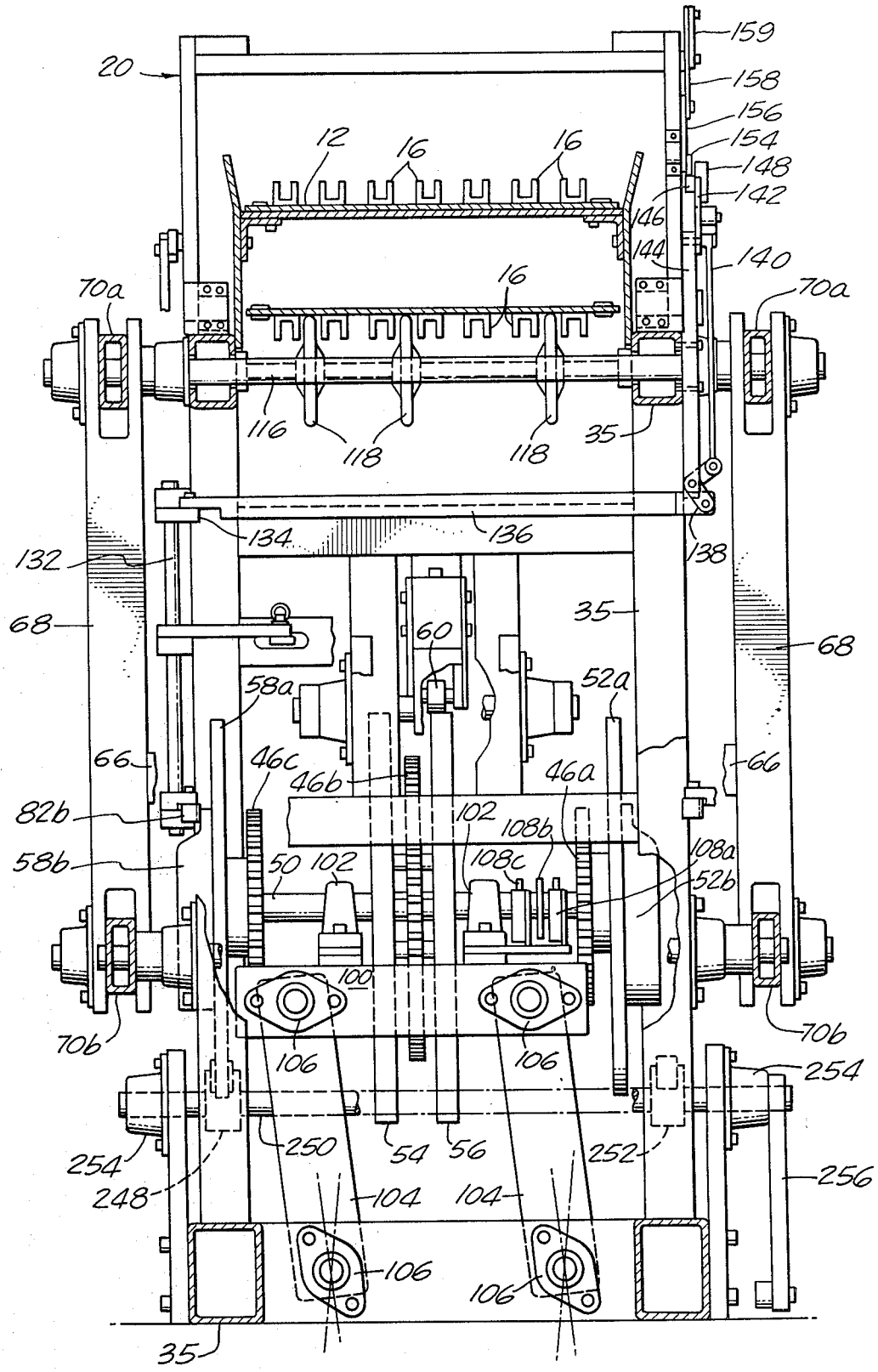
FIG. 3 is a sectional front view taken generally along the lines 303 in FIG. 1*b*.

Referring again to FIG. 2, which is taken generally along the section lines 202 in FIG. 1*b* and illustrates in sectional plan view the apparatus of FIGS. 1*a–b*, the main drive assembly is shown, including the various sprockets and cams discussed above. Also shown in FIG. 2 is a movable cam carriage 100, a front sectional view of which is shown in FIG. 3, taken along section lines 303 in FIG. 1*b*. As can be seen from FIG. 2, the cam carriage 100 supports the shaft 50 on bearings 102. In the position shown, the five tray cams 56 and 58*a–b* are aligned with their respective followers 60, 76*b* and 82*b*. It can similarly be seen that the four tray cams 54 and 52*a–b* do not engage any of their respective followers 60, 76*a* or 82*a*. Thus the movable carriage 100 is positioned to stack five trays.

If four tray packing is desired, the carriage 100 may be shifted to the right (FIG. 3), since the struts 104 of the carriage 100 are pivotably mounted at either end through bearings 106. A pair of stops (not shown) may be provided at each side to ensure that the appropriate cams line up with their respective followers when the carriage 100 is shifted for four tray or five tray packing. Thus the present invention provides means for rapidly converting from packing fruit sizes requiring four trays per carton to other fruit sizes requiring five trays per carton. Given the teachings herein, it is believed apparent to those skilled in the art that other sizes of tray stacks could readily be provided. As noted previously, only the five tray packing will be extensively described herein since it is exemplary.

Also shown in FIG. 2 are safety interlocks 108*a*, 108*b* and 108*c*, which may be rotary cam switches affixed to the shaft 50. The interlocks 108*a–c* energize microswitches at critical points during operation of the apparatus 10, and thus prevent overruns or other accidents. Thus the interlock 108*a* is associated with a microswitch 110 (shown in FIG. 1*b*, which prevents the shelf 24*a* from retracting unless the boxer assembly 74 is in position to receive the tray stack. Similarly, the interlock 108*b* prevents the shelf assembly 26 from lowering unless the boxer assembly 74 is out of the path of the shelf assembly 26, which causes it to trip a microswitch 112. Also, the interlock 108*c* energizes a microswitch 114 located on the shelf assembly 26, which prevents the feed comb 18 from pushing a tray 14 onto the first shelf 24*a* unless the shelf is fully extended so as to trip the switch 114.

Referring again to FIG. 3, which illustrates a sectional front view of the apparatus of FIGS. 1*a–*1*b* taken just in front of the cam carriage 100, the rows of double toed cleats 16 on the belt 12 are better shown. Also shown in FIG. 3 is a shaft 116 and associated idler rollers 118, which help in maintaining tension on the belt 12. FIG. 3 also provides a better view of the vertical stacker lift arms 68, shown joining the lift members 70*a* and 70*b* on each side of the apparatus 10.

Figure 4:
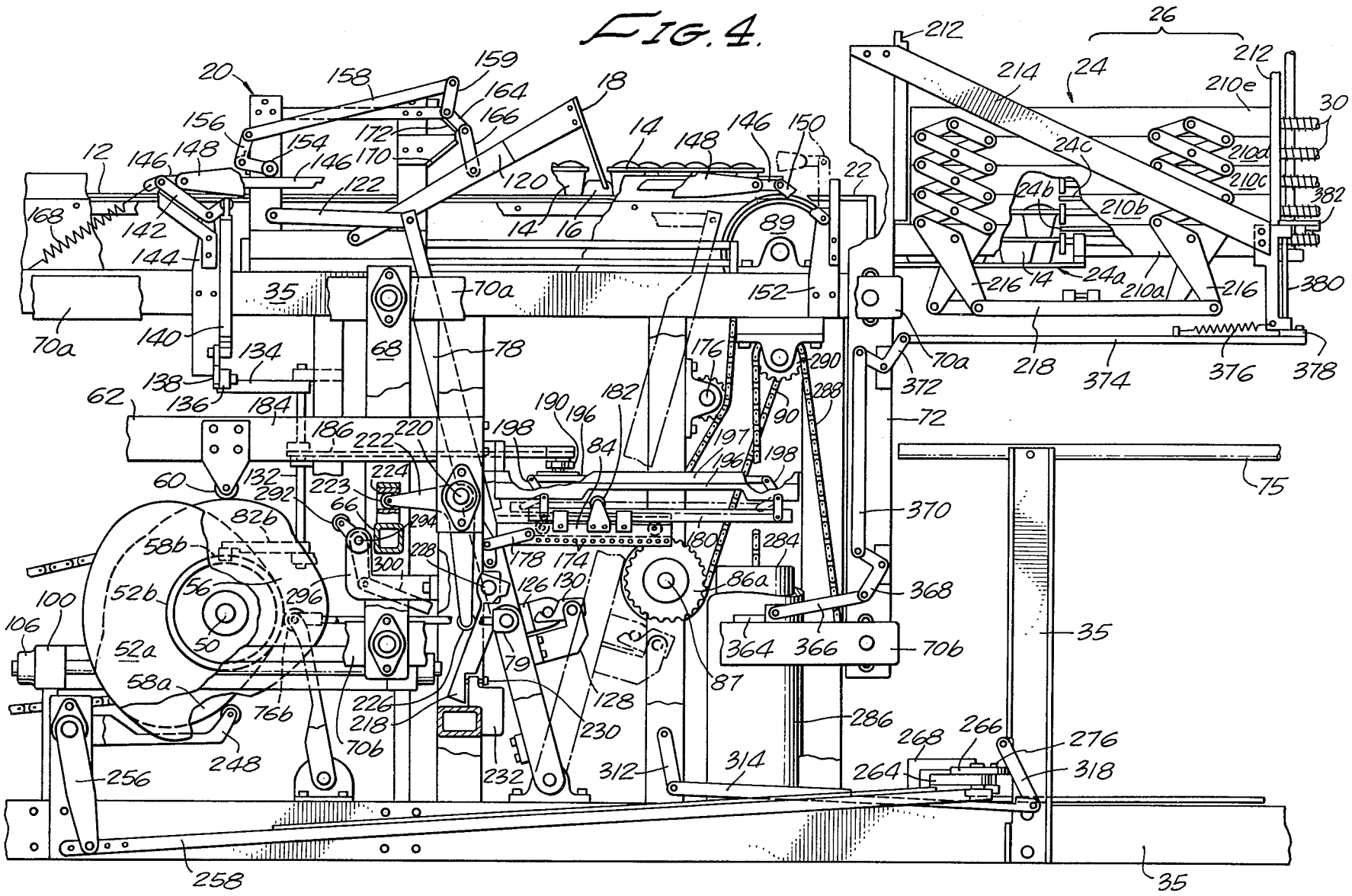
FIG. 4 is a detailed elevational side view of the middle portion of the apparatus of FIG. 1*b*.

Referring to FIGS. 3 and 4, which illustrate a front section view and a detailed side view of the apparatus of FIGS. 1*a–*1*b*, respectively, the motion whereby the feed comb 18 supplies trays to the shelf assembly 26 can be understood. As previously discussed in connection with FIGS. 1*a–*1*b*, the feed cam 58*a* controls the longitudinal travel of the feed comb 18 along the belt 12. The feed comb 18 is pivotably supported on the feed comb carriage 20 at the lower ends of a pair of support arms 120 (better seen in FIG. 5). Also pivotably attached to the feed comb carriage 20 is a pair of connecting links 122 (only one shown in FIGS. 4,5), which at their other ends pivotally attach to a pair of feed cam follower arms 78, one on either side of the apparatus 10.

The feed cam follower arms 78 are rigidly attached to a secondary cage 126 (FIG. 4) which, except as hereinafter described is continuously engaged by a primary cage 128 through a pair of cam locks 130 (also shown in FIGS. 6 and 7). The primary cage 128 is directly connected to the feed cam follower rods 79 (FIG. 2) and thus moves through fixed excursions determined by the feed cams. Thus when the primary cage 128 engages the secondary cage 126, the feed cam follower arms 78 also move, from left to right in FIG. 4, which results in the feed comb carriage 20 and the feed comb 18 also moving from left to right. Since the feed comb 18 is disposed behind a tray 14, the movement of the feed comb pushes a tray across the jump off platform 22 (FIG. 11) and onto the shelf assembly 26.

However, at the same time as the feed comb 18 is pushing a tray onto the shelves 24, the incremental belt 12 is advancing another tray into position behind the extended feed comb 18. Thus the feed comb 18 cannot directly retract, but instead must be lifted above the arriving tray and then lowered behind it in time for the next advance. This vertical movement is provided by the face cam **58*b*** in the manner described below.

Referring again to FIGS. 3 and 4, the face cam **58*b* can be seen to engage a follower 82*b*. When the rise of the cam 58*b* actuates the follower 82*b*, a comb lift shaft 132 is rotated, which in turn rotates a comb shaft arm 134. The rotation of the arm 134 pulls a comb connecting link 136, which actuates a lower pivot crank 138 affixed to the frame 35. The rotation of the pivot crank 138 actuates a vertical link 140. The downward movement of the link 140 rotates an upper pivot crank 142, which is supported by a vertical member 144 rigidly attached to the frame 35**.

The rotation of the upper pivot crank 142 lifts a rail lifter bar 146, which elevates a feed comb lift rail 148 to which it is attached. The feed comb lift rail 148 lifts and moves to the right by virtue of a rail lifter link 150 pivotably attached to the right end (FIG. 4) of the rail lifter bar 146. The right end of the lift rail 148 and the rail lifter link 150 are shown in phantom in the vertical or lifted position in FIG. 4. The rail lifter link 150 is attached at its other end to a vertical member 152 which is rigidly affixed to the frame 35. The rail lifter bar 146 and the lift rail 148 span the entire distance traveled by the feed comb carriage 20, as will be appreciated hereinafter.

Figure 5:
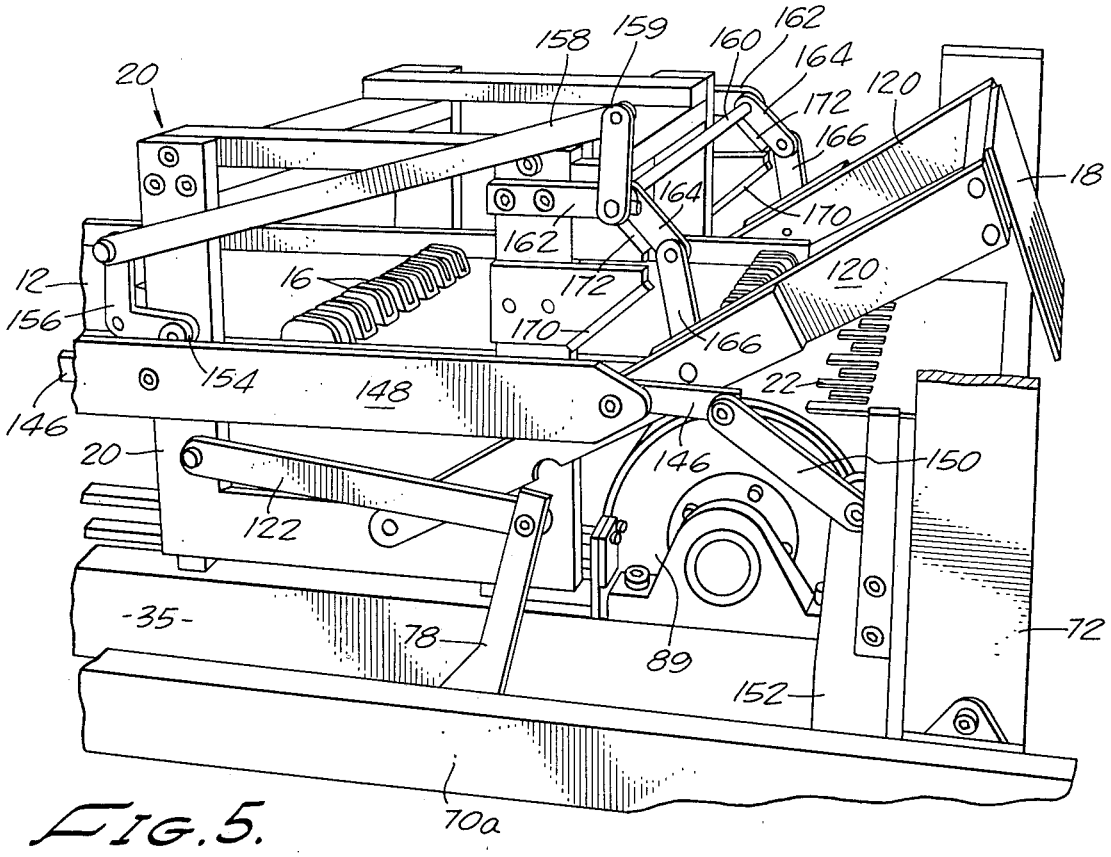
FIG. 5 is a detail view of the feed comb assembly and associated components.

When the lift rail 148 lifts, a feed comb roller 154 which rides on the rail lifter bar 146 and is affixed to a lifter bell crank 156, rotates about its pivot point on the feed comb carriage 20. This pulls a comb lifter link 158 to the left (FIG. 4). This in turn pulls a link 159, to which the lifter link 158 is connected, to the left. The link 159 is fixedly connected to a lifter rod 160 (FIG. 5). The lifter rod 160 extends across the carriage 20 and is rotatably supported by a pair of horizontal support members 162 which are rigidly attached to the carriage 20. Just inside the support members 162, a pair of connecting links 164 are rigidly affixed to the lifter rod 160, and are thus caused to rotate when the lifter link 158 pulls the link 159 to the left. It can be seen that the links 159 and 164 form a bell crank. The links 164 are connected to the feed comb support arms 120 through a pair of secondary links 166, and thus when the lifter link 158 pulls to the left, as required by the face cam **58*b*, the feed comb 18 lifts to clear the arriving tray 14**.

The feed comb 18 then fully retracts through the motion of the primary cage 128 and secondary cage 126. Because the feed comb 18 reaches across the jump off platform when fully extended, and because of the relative positions of the feed cam **58*a* and face cam 58*b*, the lifting and retraction of the feed comb 18** is one substantially continuous movement.

Once the feed comb 18 fully retracts, the face cam **58*b* has rotated sufficiently to permit the follower 82*b* to return to a dwell position. The upper pivot crank 142 is then pulled back to a neutral position by a spring 168, and the comb lift rail 148 falls. The feed comb 18 is therefore lowered in behind the newly arrived tray 14, ready for the next cycle. For high speed operation of the packing apparatus 10 it may be desirable to provide bumpers 170 and 172, made of any suitable shock absorbing material to cushion the rapid movements of the links 164 and the support arms 120**.

In addition to controlling the movement of the feed comb 18, the feed cam **58*a* and face cam 58*b* also control the movement of the incremental belt 12. The incremental motion of the belt 12 is effected by the engagement of the belt rack 84 with the sprocket 86*a* as shown generally in FIG. 1 and in greater detail in FIGS. 4 and 8. The belt rack 84 engages the sprocket 86*a* by means of a series of pins 174, and may for example be comprised of a pair of parallel plates with the pins situated therebetween for engagement with the sprocket 86*a*. The rotation of the sprocket 86*a* is then communicated to a sprocket 86*b*, connected to the sprocket 86*a* by a common shaft 87. The rotation of the sprocket 86*b* is then conveyed to the incremental belt 12 via a toothed sprocket 88 and chain 90 as described in connection with FIG. 1*b*. An idler sprocket 176** may also be provided.

The belt rack 84 is moved horizontally while engaged with the sprocket 86 by the movement of the primary cage 128 and secondary cage 126, which in turn is controlled by the feed cam **58*a* as previously described. On the forward, or feed stroke of the secondary cage 126 (left to right in FIG. 4, right to left in FIGS. 6 and 7), the secondary cage 126 advances the belt rack 84 while engaged with the sprocket 86 by means of a follower arm rack link 178. The rack link 178 is pivotally connected at its end to the secondary cage 126 and the belt rack 84, respectively. The belt rack 84 is guided along a rack guide 180 by a rack guide roller 182 and side guides 183. The incremental belt 12 is thus advanced synchronously with the feed comb 18**.

During retraction or the return stroke of the secondary cage 126, the movement of the belt rack 84 is substantially different. To prevent the incremental belt 12 from backing up during retraction of the secondary cage 126, the belt rack 84 must be disengaged from the sprocket 86. This movement is provided by the face cam **58*b*. When the belt rack is fully advanced, the feed comb 18 is likewise fully extended, at which point the rise on the face cam 58*b* causes the comb lift shaft 132 to rotate. This also rotates a belt rack crank 184, which is connected to a rack yoke link 186 at its other end. The rack yoke link 186, shown also in FIGS. 6, 7 and 8 extends through a slot 187 in a crossmember 188 of the frame 35 and pivotably connects at its end to a belt rack yoke 190. The belt rack yoke 190 is rotatably supported in its midsection by a stationary support member 192. The belt rack yoke 190 engages a roller 194 on a rack guide lifter 196**.

Figure 7:
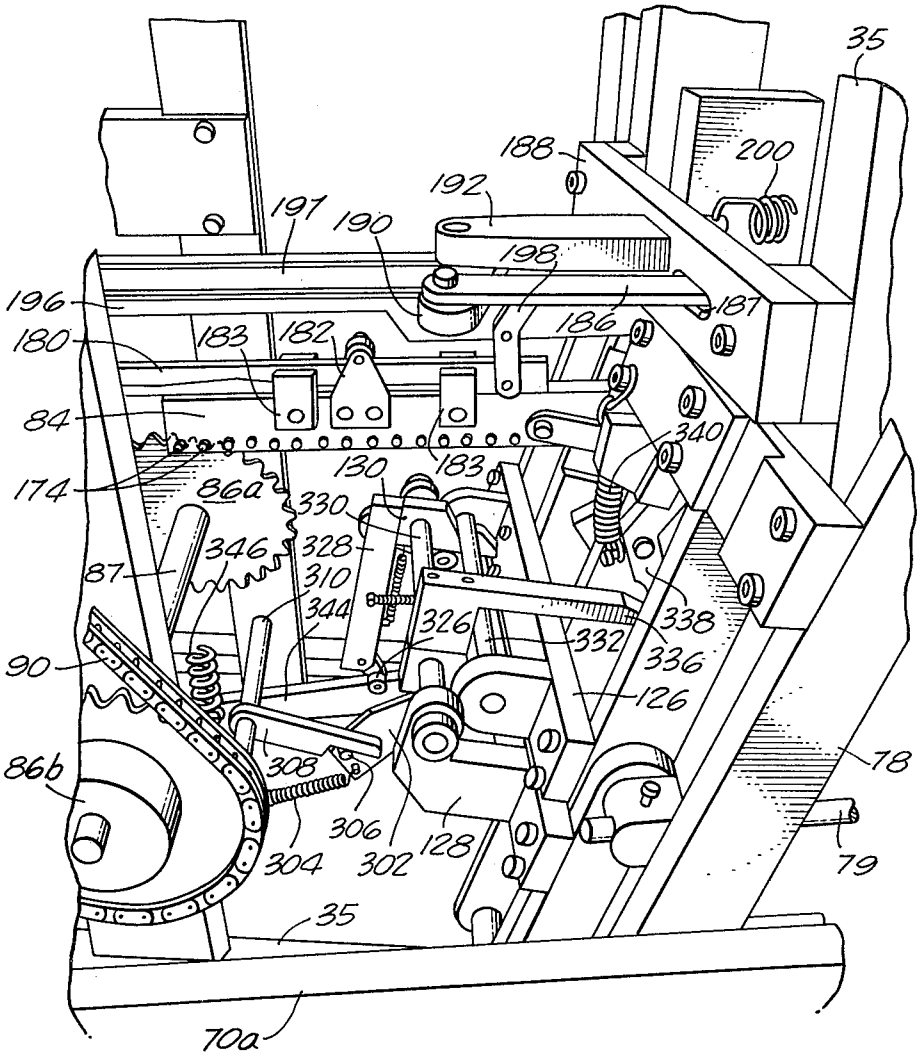
FIGS. 6 and 7 are detail views of the primary cage and secondary cage and associated elements shown in FIGS. 1*b* and 4.
Figure 6:
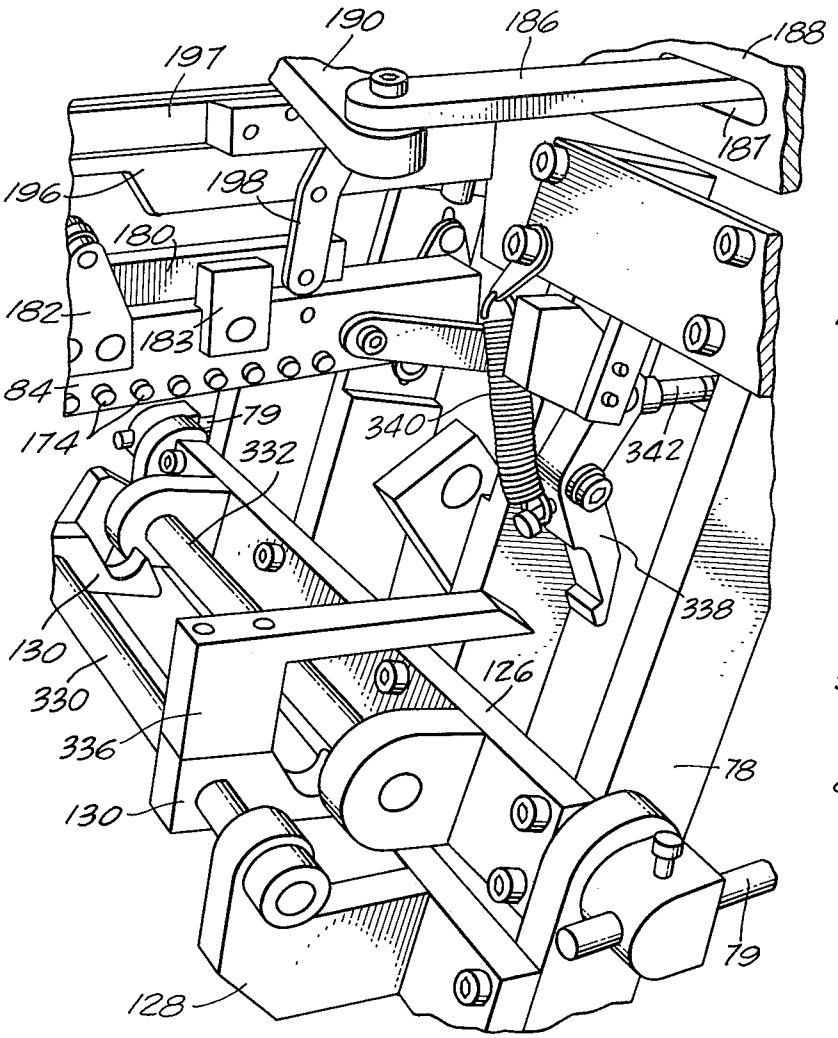
Figure 8:
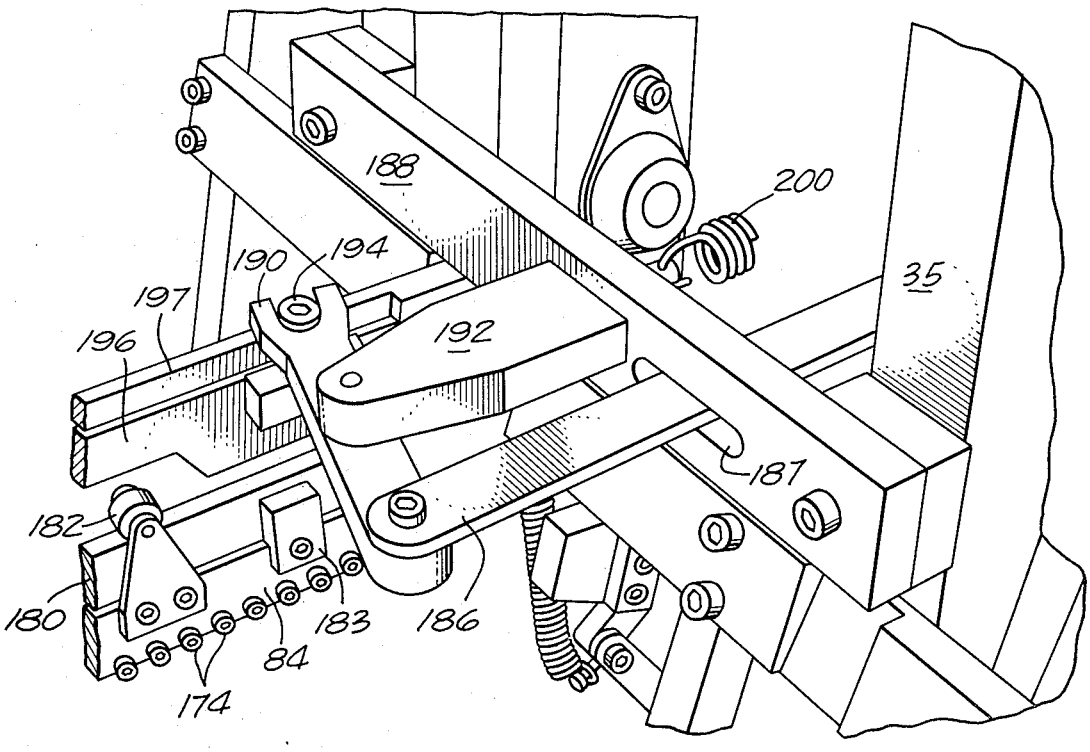
FIG. 8 is a detail view of the belt rack and belt rack yoke of the apparatus.

When the rack yoke link 186 is pulled forward, the rack yoke 190 is pivoted about the support member 192, pulling the rack guide lifter 196 back (left to right in FIG. 4; right to left in FIGS. 6–8). The backward movement of rack guide lifter 196 pivots a pair of pivot cranks 198, which are supported at their pivot points by a lower guide 197 and connected to the rack guide 180 at their other ends, thereby raising the rack guide 180. The raising of the rack guide 180 in turn raises the belt rack 84, disengaging the latter from the sprocket 86*a*.

Once the belt rack 84 has retracted, the face cam 58*b* rotates and the follower 82*b* falls. The belt rack crank 184 is then pulled back to its neutral position by a spring 200, which is connected at its other end to the back of the support member 192. The belt rack yoke 190 then pivots about the support member 192 to cause the rack guide 180 to lower into position for the next advance stroke as described above. This cyclic engagement and disengagement of the belt rack 84 with the sprocket 86*a* provides a continuous indexing of the incremental belt 12, thereby preventing slight registration errors from accumulating. Thus good synchronization of the incremental belt with the remainder of the apparatus is provided.

The foregoing discussion has explained the movement of the feed comb 18 and incremental belt 12 in supplying trays 14 of fruit to the shelf assembly 26. The manner by which the shelf assembly 26 receives and stacks the fruit laden trays remains to be discussed in greater detail than given in connection with FIG. 1*b*.

As discussed previously, the vertical movement of the shelf assembly 26 is primarily controlled by the rotation of the main cam 56 (FIG. 4), which communicates its five dwells and one rise through a main cam follower 60 affixed to a main cam arm 62. The left end of the main cam arm 62 terminates in a shaft and pillow block assembly 64 shown in FIG. 2. As previously described, the motion of the main cam arm is then indirectly, as will be explained hereinafter, transmitted to the shelf assembly 26.

Figure 9:
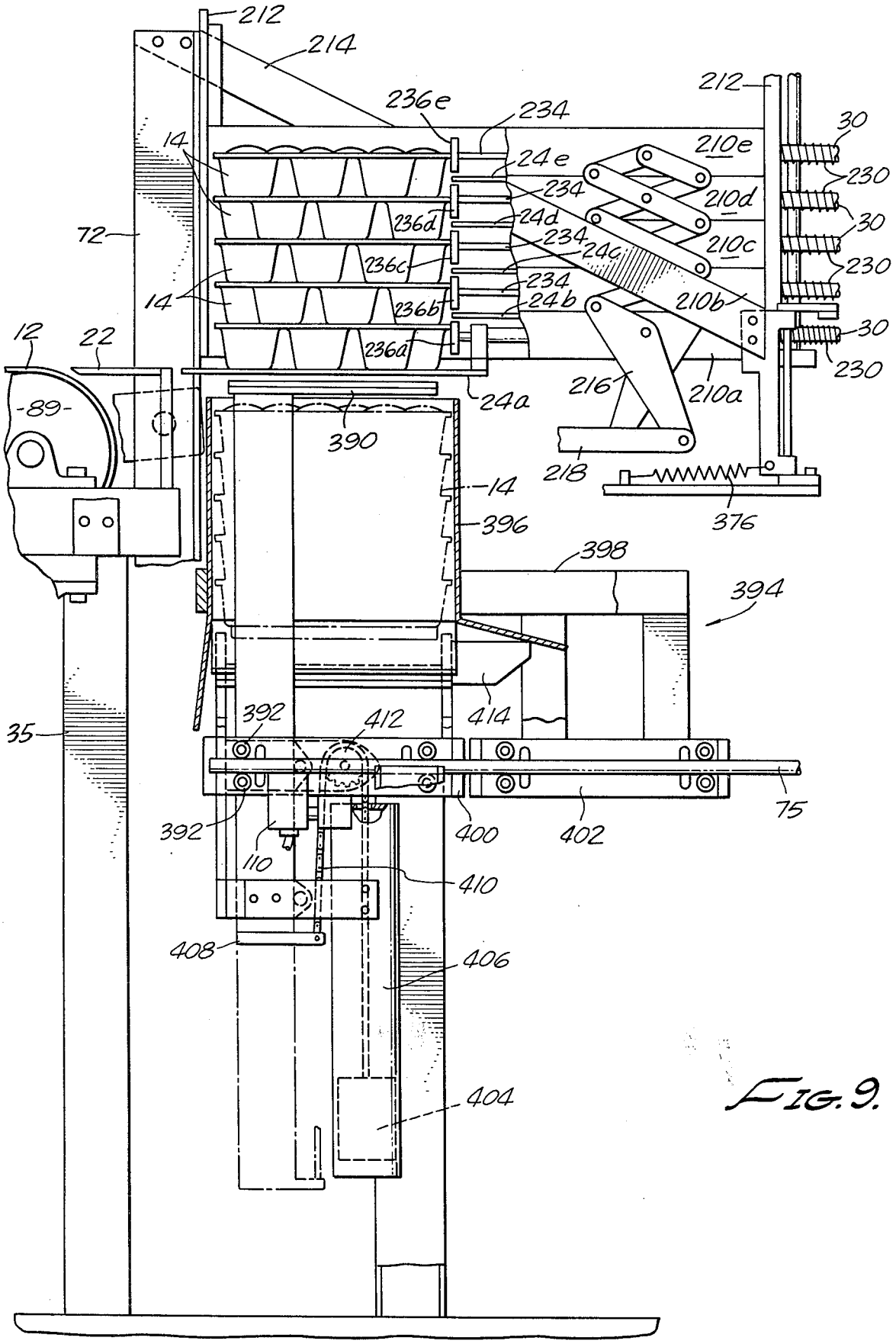
FIG. 9 is a detail elevational side view of the shelf assembly and boxer mechanism, with the boxer mechanism ready to receive a nested stack of trays.

The shelf assembly 26 includes a plurality of shelves 24, for example five shelves 24*a–e* as shown in FIG. 9, shelves 24*a–c* being shown in FIG. 4. The shelves 24*a–e* each ride in a shelf guide 210*a–e*, respectively, which supports each shelf on its sides and at the outside edges of the bottom of the shelf. The shelf assembly 26, and each of the shelf guides 210*a–e*, are slightly more than twice as long as the shelves 24; and the shelf is slightly wider than a tray 14. Thus, for a tray twelve inches wide, the shelf guides 210*a–e* are slightly more than two feet long. This permits each shelf 24*a–e* to be fully supported during extension and retraction, which will be better explained in connection with FIG. 12.

The shelf guides 210*a–e* are supported at their four corners by vertical members 212, which are connected by an oblique crossmember 214. The shelf guides 210*a–e* are connected to one another by four scissors links 216, two on either side of the shelf assembly 26. The scissors links 216 on each side are connected by an adjustable linkage 218, which permits the scissors links 216 to be closed. Closing the scissors links 216 adjusts the vertical spacing between the shelf guides 210*a–e*, which permits the shelf assembly 26 to readily accommodate a variety of fruit sizes. To permit smooth vertical movement of the shelf guides 210*a–e*, the vertical members 212 may be U-shaped, and the shelf guides may have rollers (not shown) at their corners which engage the interior of the vertical members 212.

Because the vertical spacing of the shelves 24, which receive the tray 14, is adjustable, it becomes apparent that the incremental downward movement of the shelf assembly 26 must be similarly adjustable if the fixed excursions of the main cam arm 62 are to cause each of the shelves 24*a–e* to align with the jump off platform 22 at the appropriate time. This adjustability is provided by an extender cam 218, shown in FIGS. 4 and 10, which operates in conjunction with the main cam arm 62.

Figure 10:
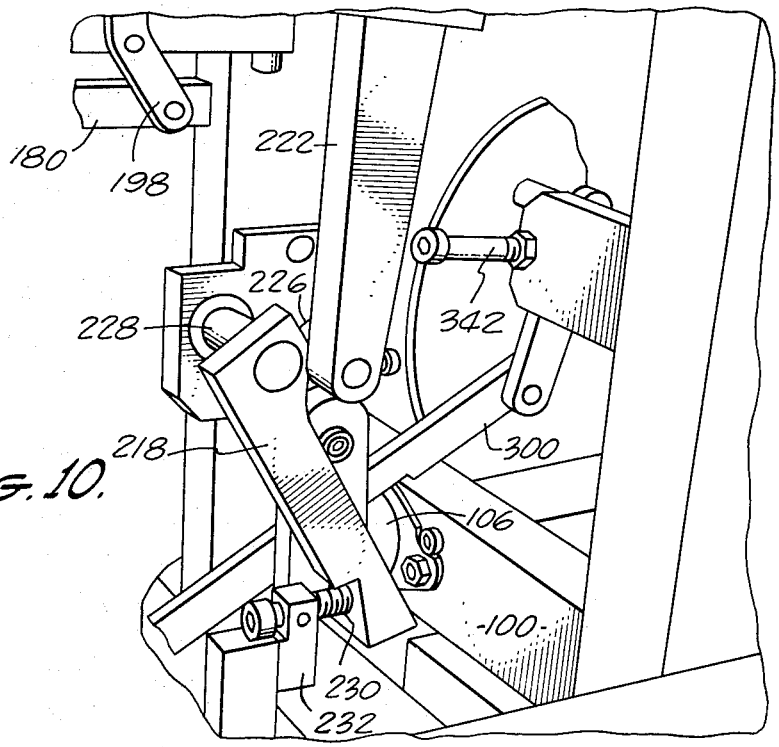
FIG. 10 is a detail view of the extender cam portion of the apparatus.

The right end of the main cam arm 62 (FIG. 4) terminates in a spacer bell crank pivot 220, to which a spacer bell crank 222 is pivotably affixed, with its long arm extending downward and its short arm extending forward (to the left in FIG. 4; to the right in FIG. 10). The short arm of the spacer bell crank 222 terminates in a roller 223 which is enclosed in a spacer bell cage 224 which is rigidly affixed to the stacker lifter crossmember 66. The stacker lifter crossmember 66 is rigidly affixed to the vertical stacker lift arms 68 as described in FIG. 1*b*, which are connected to the shelf assembly 26 through the lift members 70*a–b* and another vertical member 72.

The long arms of the bell crank 222 terminates in an extender cam follower 226 which continuously engages the extender cam 218. The extender cam 218 is rotatably supported at its upper end by a pivot 228, and the angle it subtends may be varied by means of an adjustment screw 230 which is threaded through a supporting member 232 that is rigidly affixed to the frame 35. To ensure that the adjustment of the travel of the shelf assembly 26 matches the inter shelf spacing, the adjustment screw 230 is preferably adjusted simultaneously with the adjustable linkage 218 by any suitable automatic or manual means.

When the shelf assembly 26 is at the top of its travel (shelf 24*a* aligned with the jump off platform 22), the extender cam follower 226 is at the top of the extender cam 218. Since the alignment of the first shelf 24*a* with the jump off platform 22 may be regarded as a "home" or starting position, no vertical adjustment is necessary and the follower 226 only lightly engages the cam 218. However, and as shown in FIG. 4, when the shelf assembly 26 is moved incrementally downward to align the next shelves with the jump off platform 22, the follower 226 engages the cam 218, thereby pivoting the bell crank 222 about the pivot 220. This permits the crossmember 66 to lower by an amount determined by the angle of the extender cam 218, thereby commensurately lowering the shelf assembly 26.

The extender cam 218 permits the shelf assembly 26 to lower either a lesser distance or a greater distance than the main cam arm 62. By adjusting the extender cam 218 so that the bottom of the cam 218 extends beyond a neutral position toward the main cam 56, the stacker lifter cross-member 66 travels less distance than the main cam arm 62. This may be referred to as compression. However, if the bottom of the cam 218 extends beyond a neutral position away from the main cam 56, the crossmember 66 travels a greater distance than the main cam arm 62, or what may be referred to as expansion.

Figure 11:
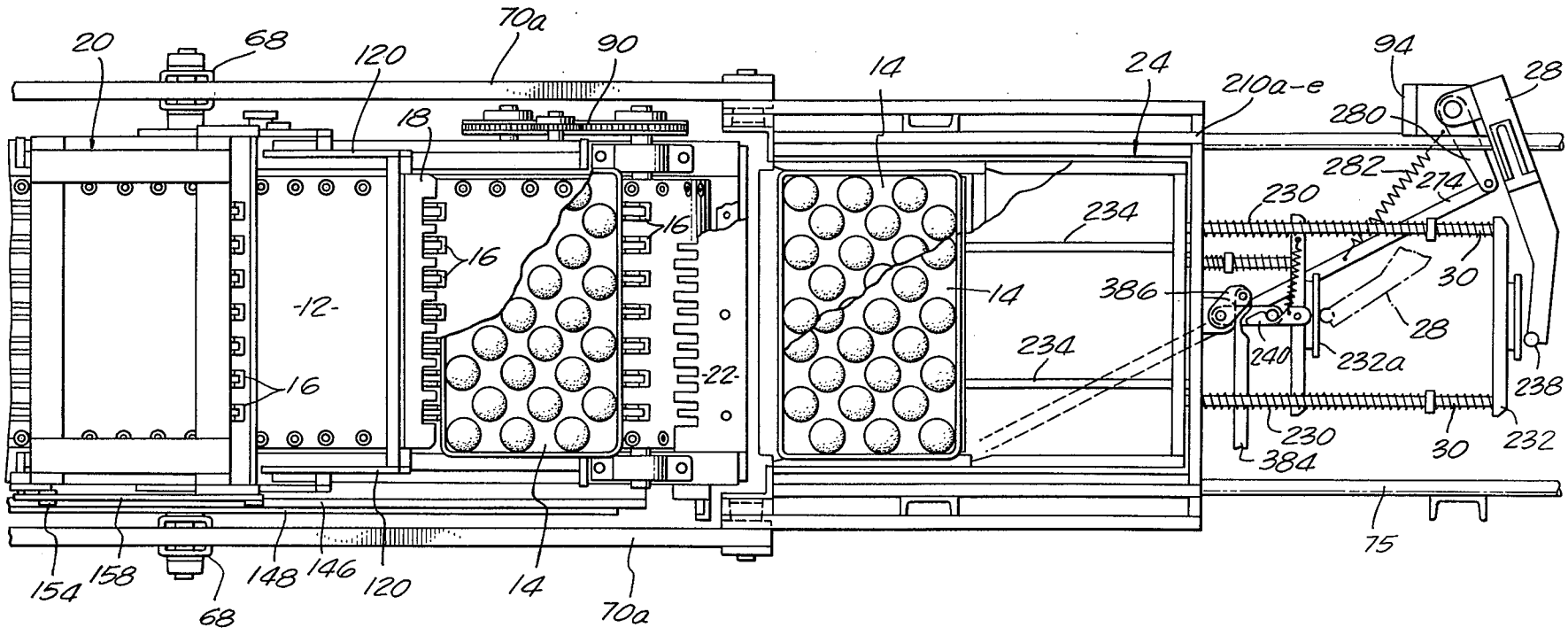
FIG. 11 is a detail plan view of the right end of the apparatus shown in FIG. 1*a*, not including the boxer mechanism.

Referring now to FIGS. 4, 9 and 11, the means by which the shelf assembly stacks a plurality of fruit-laden trays 14 will be described in detail. As discussed generally in connection with FIGS. 1*a–*1*b*, the shelves 24*a–e* are extended into position to receive a tray 14 just before the tray is pushed off the jump-off platform 22 by the feed comb 18. Each of the shelves 24 are affixed to a pair of spring loaded shelf rods 30, with the springs 230 located between the back of the shelf guides 210*a–e* and a pressure plate 232 which connects to the remote end of the shelf rods 30, also seen in FIG. 12. A third shelf rod 233 may be added to the first shelf 24*a* if desired.

Also attached to the shelf guides 210*a–e* are a pair of stripper bar rods 234, which support stripper bars 236*a–e* (FIG. 9). As can be seen from FIG. 11, the stripper bar rods 234 extend through holes in the back of each shelf 24, and thus are supported independently of the shelves 24, for purposes which will become clear hereinafter.

The shelves 24 are placed in the extended position by the rotation of the reset arm 28, which terminates in a reset arm roller 238. When the reset arm rotates, the roller 238 engages the pressure plate 232 of the shelf 24 with which it is then aligned. This extends the shelf to a position suitable for receiving a tray 14, which position is shown in FIG. 11. The position of the reset arm 28 when the shelf 24 is fully extended is shown in phantom in FIG. 11.

Figure 12:
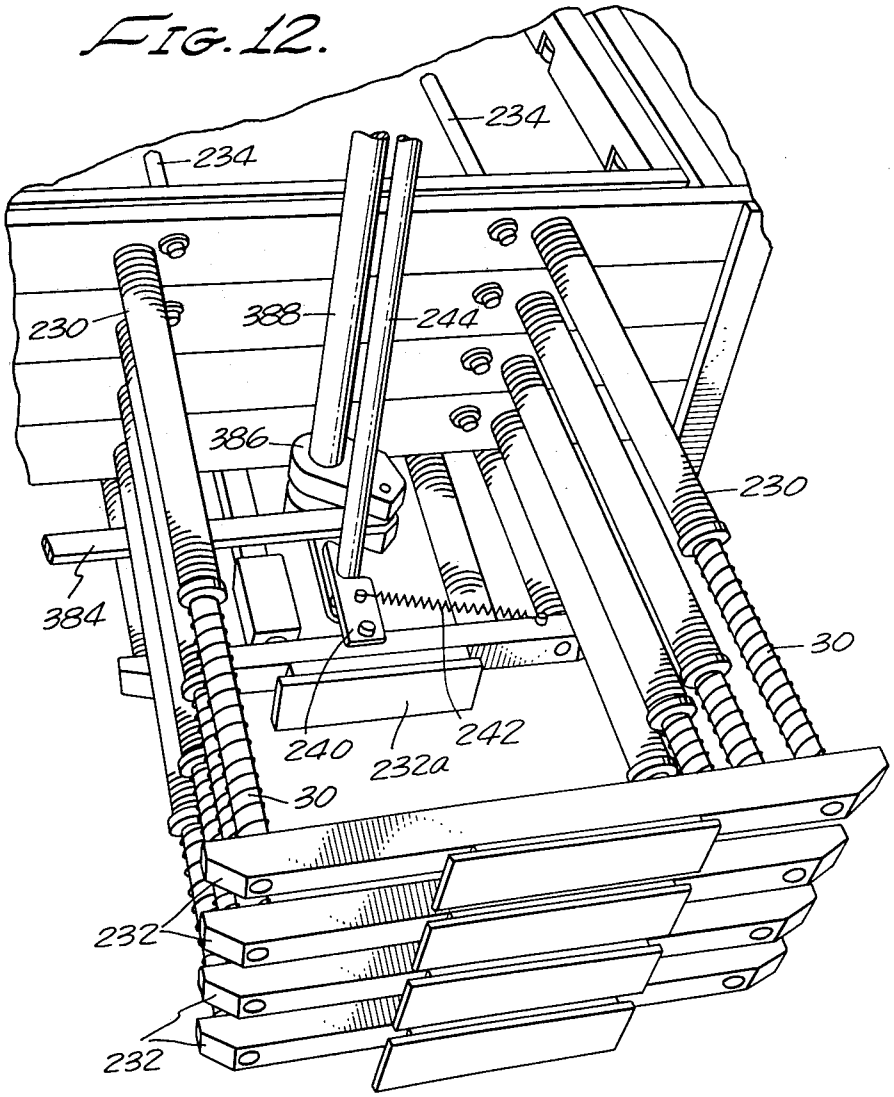
FIG. 12 is a detail view of the shelf latch portion of the apparatus.

As shown in FIGS. 11 and 12, the first shelf 24*a* differs significantly from the remaining shelves 24*b–e*, in that the first shelf 24*a* is caused to latch in the extended position by a cam shelf latch 240. When the reset arm 28 pushes in the pressure plate 232*a* associated with the shelf 24*a*, the cam latch 240 pivotably mounted on the pressure plate 232*a* is urged, by spring 242 which extends from the cam latch 240 to the pressure plate 232*a*, into engagement with a shelf latch rod 244. The shelf latch rod is fixedly supported by a member 246 affixed to the shelf assembly 26. The shelf 24*a* is thus locked into the extended position when the first tray 14 arrives.

Referring again to FIGS. 3, 4 and 11, and also FIG. 13, the mechanism which causes the rotation of the reset arm 28 may be understood. Referring first to FIGS. 3 and 4, a reset arm follower 248 is shown in engagement with the feed cam 58*a*. The reset arm follower 248 is preferably set approximately 90° in advance of the feed cam follower 76*b* to maintain proper synchronization between the tray feed sequence described above and the movement of the reset arm 28, although a suitable amount of advance is acceptable. The reset arm follower 248 responds to a rise in the feed cam 58*a* by pivoting a reset arm follower shaft 250 (FIG. 3) to which the follower 248 is connected. A similar follower 252, but positioned for engagement during four tray packing is also affixed to the shaft 250. The shaft 250 is pivotably supported by a pair of bearings 254. The end of the shaft 250 is rigidly connected to a reset arm follower crank 256, which is pulled to the left (FIG. 4) when the shaft 250 is rotated by the rise on the feed cam 58*a*.

The lower end of the crank 256 is pivotably connected to a reset arm follower link 258, which extends along the frame 35 to an arm 260, to which it is rigidly affixed. A latch link pin 262 is mounted in the end of the arm 260, and in turn provides support for a pivot arm 264 and a crescent latch 266. The other end of the pivot arm 264 is pivotably supported in a pivot cage 268 by a reset link pivot 270. A spring 271 is also mounted on the pivot arm 264 and extends across to one end of the crescent latch 266, urging the latch 266 to rotate about the latch link pin 262.

Also pivotably supported by the reset link pivot 270 is a reset link arm 272. The reset link arm 272 is connected to a reset tower link 274 by means of a reset link stud 276, which sticks up above the arm 272 in a position to engage a locking notch 278 (better seen in FIG. 14) in the crescent latch 266. The reset tower link 274 in turn rotatably connects to a reset tower shaft arm 280, which is rigidly affixed to the tower shaft 96. The shaft 96 is supported by the reset tower 94 and at its upper end is rigidly connected to the reset arm 28.

It can thus be seen that when the crank 256 pulls the follower link 258 to the left, the pivot arm 264 is likewise pulled to the left and causes the notch 278 in the crescent latch 266 to lock onto the reset link stud 276. This, then, pulls the reset tower link 274, causing the shaft arm 280 to rotate the shaft 96. The reset arm 28 is thus rotated into engagement with the pressure plates 232 as described above. A spring 282 (FIG. 11) spans between the reset tower link 274 and the tower 94 to urge the reset arm to a neutral position. After the rotation of the feed cam 58*a* has caused the reset arm to fully extend a shelf 24, the continued rotation of the cam 58*a* permits the spring 282 to urge the reset tower link 274 to a neutral position, thereby returning the remaining linkage to its neutral, or disengaged position.

As explained above, once the first tray is pushed onto the first shelf 24*a*, the rotation of the main cam 56 causes the shelf assembly 26 to move incrementally downward, moving the next shelf (24*b*) into alignment with the jump-off platform 22 and concurrently moving the associated pressure plate 232 into alignment with the reset arm 28. The reset arm 28 then extends the shelf 24*b* into position to receive the tray 14, and the feed comb 18 pushes the tray up against the stripper bar 236*b*, directly above the tray on the shelf 24*a*.

However, the second shelf 24*b* does not latch, and when the reset arm 28 rotates back to its start position, the springs 230 cause the shelf 24*b* to fully retract. The stripper bar 236*b*, however, prevents the second tray from retracting, and the now unsupported tray settles atop the tray resting on the first shelf 24*a*. As previously discussed, the trays 14 are alternately arranged to facilitate nesting in a conventional manner.

After the second shelf 24*b* has retracted, the main cam 56 has rotated sufficiently to move the shelf assembly 26 downward another increment, aligning the next shelf with the jump-off platform 22. The shelf is extended by the reset arm 28 as described for the second shelf 24*b*, the feed comb 18 pushes a tray onto the shelf, and the shelf retracts as with the shelf 24*b*, leaving a nested stack of three trays. Similarly, two more trays are stacked, resulting in a stack of five nested trays rested on the latched first shelf 24*a*.

From the above can be seen the manner by which the shelves 24 of the shelf assembly 26 are extended, so that a tray stack is left resting on the latched first shelf 24*a*. At this point, as previously noted, the shelf assembly 26 is at its lowest point. Before the boxer assembly 74 can move into position beneath the shelf assembly 26 to receive the stack of trays, the shelf assembly must be returned to its topmost position. This is provided by long "rise" on the main cam 56. It should be noted that a pair of counter-weights 284 contained within a housing 286 and connected by a chain 288 and pulley 290 to the vertical member 72 (FIG. 4) which supports the shelf assembly 26, serves to balance the forces required to return the shelf assembly 26 to its starting position.

However, while the shelf assembly 26 is being returned to its top position, and also while the stack of trays is being placed in the carton carried on the boxer assembly 74, the shelf assembly cannot receive any additional trays, and the retracted shelves cannot be extended. Thus, during this period the feed comb 18, the incremental belt 12 and the reset arm 28 must be disabled, or caused to pause. Since the cycloidal feed cams continuously rotate, other means must be provided for enabling this pause to occur. This is the purpose of a pause follower 292 (FIGS. 2, 4).

The pause follower 292 is supported by a shaft 294 affixed to the frame 35, and is positioned to engage the main cam 56 only during the "rise" and last "dwell" portion of the cycle, or until the tray stack has been placed in the carton and the shelf assembly 26 is capable of receiving additional trays. When the pause follower 292 engages the cam 56, the follower pivots on the shaft 294, which is supported by an arm 296. The rotation of the shaft 294 pulls a pause follower arm 298 rigidly mounted thereto to the left (FIG. 4). The pause follower arm 298 is connected at its other end to a pause follower link 300, which is therefore pulled to the left simultaneously.

Figure 15:
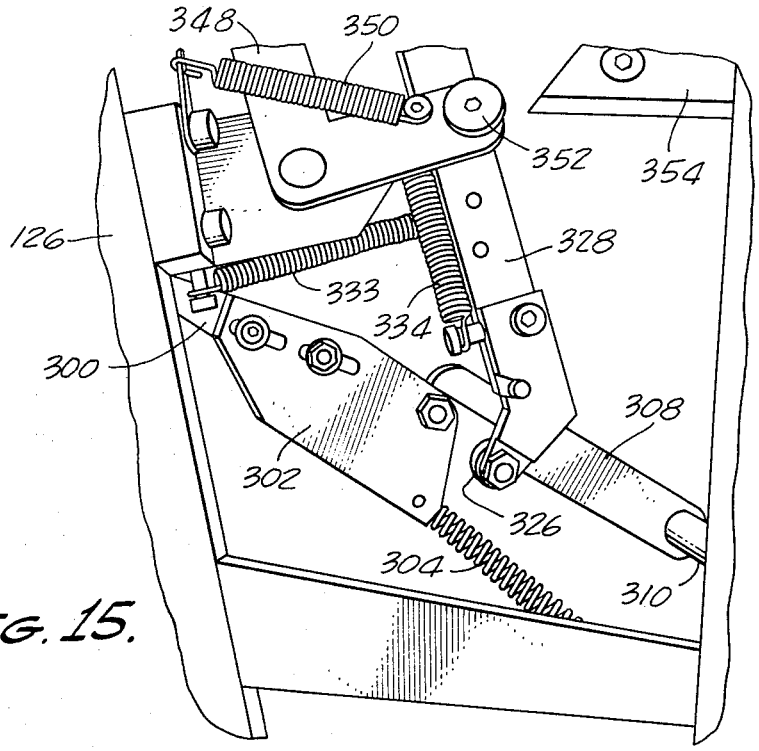
FIG. 15 is a detail view of the pause cam plate and associated elements of the apparatus.

The pause follower link 300 terminates in a pause cam plate 302, shown in FIG. 14. When the link 300 is pulled to the left, the cam plate 302 is lifted against the force of a spring 304, connected therebelow to the frame 35. A roller 306 (FIG. 7) is supported by the cam lock plate and continuously engages a crescent latch actuator crank 308 (FIG. 15), so that when the pause follower link 300 is lifted, a crescent latch crank shaft 310, to which the crank 308 is rigidly connected, is rotated. The shaft 310 extends through the frame 35 and terminates in a crank shaft arm 312 shown in FIG. 4. The crank shaft arm 312 thus pivots to the left (FIG. 4) when the pause follower link 300 is lifted.

The crank shaft arm 312 is pivotably connected to a crescent latch link 314, and the movement of the arm 312 is thus communicated to the link 314, against the force of a spring 316 (FIG. 13) which extends between the link 314 and the pivot cage 268. The crescent latch link 314 is connected at its other end to a latch link arm 318, which is connected to a latch release arm 320 through a shaft 322. The shaft 322 is rotatably supported by a member 324 affixed to the frame 35.

When the crescent latch link 314 is pulled to the left by this lifted cam plate 302 due to the action of the pause follower 292, the latch link arm 318 is likewise pulled to the left. This causes the latch release arm 320 to engage the crescent latch 266 when the reset arm follower link 258 is pulled to the left by the reset arm follower 248. This prevents the locking notch 278 on the crescent latch 266 from engaging the stud 276, which disconnects the reset tower link 274 from the reset arm follower link 258. The reset arm 28 is thus disabled for the duration of the pause, or until the pause follower 292 is disengaged from the main cam 56.

Figure 16:
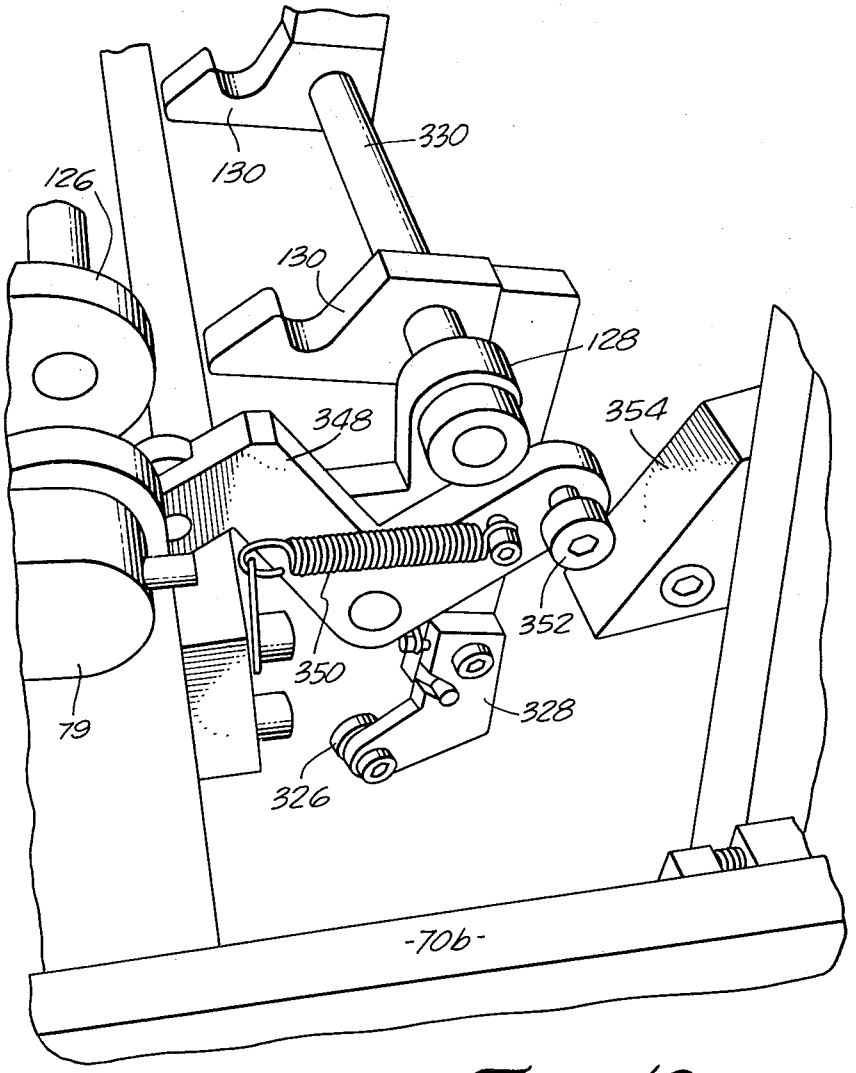
FIG. 16 is a detail view of a portion of the latch release linkage of the apparatus of FIG. 1*b*.

The incremental belt 12 and feed comb 18 are disengaged in a similar manner during the pause, although their disengagement is via the cam locks 130 associated with the primary cage 128 (FIG. 6). Referring again to FIG. 15, when the cam plate 302 is lifted by the pause follower 292, it is placed in position to engage a cam lock follower 326 which is supported on a cam lock arm 328. The cam lock arm 328 is connected to the pair of cam locks 130 which are supported on the primary cage 128 and move therewith (FIGS. 7 and 16). The cam locks 130 are connected together by being rigidly affixed to a cam lock shaft 330 which is rotatably supported by the primary cage 128.

When the primary cage 128 next moves to the left (FIGS. 6, 7 and 16) after the pause cam plate 302 (FIG. 15) has lifted to its upper position, the cam lock follower 326 engages the cam plate 302. This pivots the cam lock arm 328 about the cam lock shaft 330, causing the cam locks to rotate downward, away from engagement with a locking shaft 332 supported by the secondary cage 126. The pivoting of the cam lock arm 328 is against the force of a cam lock spring 333 which extends between the cam lock arm 328 and the primary cage 128. To ensure a definite release of the cam locks 130, the primary cage is designed to slightly overtravel the secondary cage. When the cam plate 302 is in the lowered position (i.e., no "pause"), a cam lock overtravel spring 334 (FIG. 15) extending between the cam lock arm 328 and the primary cage 128 prevents the cam locks 130 from accidentally coming unlatched during overtravel.

In addition, a secondary latch 336 (FIG. 6) affixed to the cam lock 130 may be provided for engagement with a clasp 338 which is pivotably supported by a bolt affixed to the secondary cage 128. When the cam locks 130 engage the locking shaft 332 (no "pause"), the clasp 338 is urged into engagement with the secondary latch 336 by a clasp spring 340 supported at its other end by the secondary cage 126. However, during the "pause" protion of the cycle, the return of the secondary cage 126 to its reset position pushes the clasp 338 up against a stop bolt 342, disengaging the secondary latch 336 from the clasp 338 and permitting the cam locks 130 to release in the manner described above.

By releasing the secondary cage 126 from the primary cage 128, both the belt rack 84 and the feed comb 18 are disabled until the end of the pause. Thus, even though the feed cam follower rods 79 (FIG. 2) continue to move the primary cage 128, the secondary cage 126 has been smoothly disconnected and the incremental belt brought to a halt without substantial sudden or jerking movement which might tend to displace the fruit from the tray pockets in which it rests. To ensure that the secondary cage 126 remains firmly in its rest position during the pause, a pair of arms 344 (FIGS. 7, 13) extend from the base of the secondary cage 126, to which are attached springs 346 which extend upward to the frame 35.

With the incremental belt 12, the feed comb 18 and the reset arm 28 all disabled for the duration of the pause, and the shelf assembly 26 returned to its top position, the boxer assembly 74 may be moved into position beneath the shelf assembly 26 in preparation for the "drop," or the placement of the stack of trays 14 into a carton carried on the boxer assembly 74 (FIG. 9). This requires that the shelf latch 240 be released, which occurs as follows.

Figure 17:
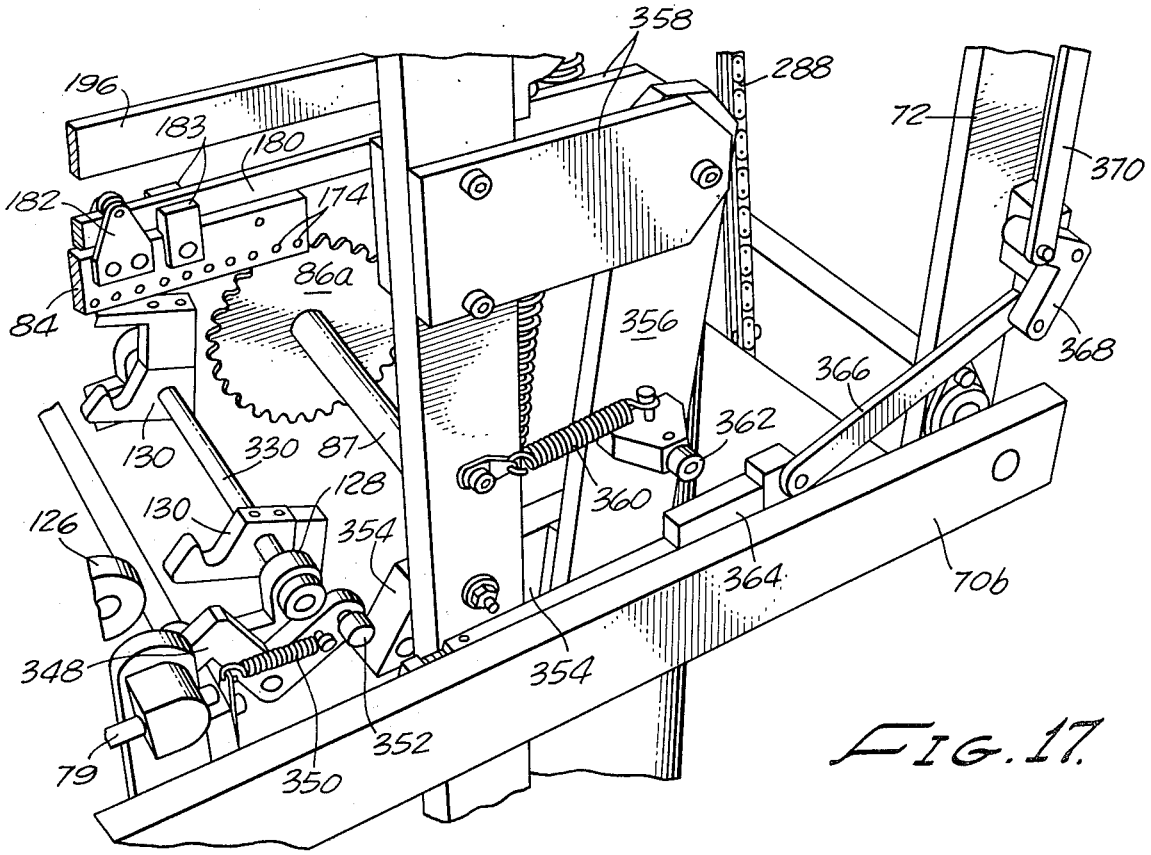
FIG. 17 is a detail view of a further portion of the latch release linkage.

When the primary cage 128 separates from the secondary cage 126, a drop bell crank 348 (FIGS. 16, 17) which is pivotally supported by the primary cage 128 and held against the secondary cage 126 when the cages are locked together, is caused to pivot from the force exerted by a bell crank spring 350. This causes a bell crank roller 352 supported on the bell crank 348 to rise sufficiently to strike the face of a drop actuator lever 354, although it would have passed below the face 354 when the cages are locked together. This moves the drop actuator lever 354 to the right, as better seen in FIG. 17, and similarly moves to the right a drop lever arm 356 to which the lever 354 is rigidly connected. The drop lever arm 356 is pivoted at its top between a pair of horizontal members 358. A spring 360 connects the frame 35 to a drop slide roller 362 mounted on the drop lever arm 356, the spring 360 being in opposition to the force exerted by the drop bell crank 348.

Once the shelf assembly 26, and thus its lift members 70*b*, return to their top position, the drop slide roller 362 moves into alignment with a drop actuator slide 364, which is slidably supported on the lift member 70*b*. On the next motion of the primary cage 128 (i.e., the second and last such motion during the "pause"), the drop slide roller 362 engages the drop actuator slide 364 and pushes it to the right. The slide 364 in turn drives a lower drop link 366 to the right and pivots a lower drop crank 368 about its pivot pin which is supported on the vertical member 72.

The rotation of the lower drop crank 368 exerts a downward force on a vertical link 370, connected between the upper side of the drop crank 368 and the lower side of an upper drop crank 372. The downward force on the drop crank 372, which is supported on the vertical member 72, pulls a horizontal link 374 to the left against the force of a spring 376. The spring 376 is connected between the link 374 and the shelf assembly 26. The force on the horizontal link 374 pulls a lower drop lever 378 to the left.

The lower drop lever 378 is connected rigidly to a shaft 380, which extends vertically and is rotatably supported by the shelf assembly 20. The shaft 380 terminates in an upper drop lever 382 (FIG. 4), which in turn is connected to a cam link 384 (FIGS. 11, 12). The cam link 384 connects directly to a latch release cam 386 which is pivotably supported on a latch release cam shaft 388. Thus when the lower drop lever 378 is pulled to the left (FIG. 4) the latch release cam 386 engages the shelf latch 240, driving it to the left (FIG. 12). This permits the springs 230 to cause the shelf 24*a* to retract, depositing the tray stack on the boxer assembly 74, and more particularly on a counterweighted drop shelf 390 therein (FIG. 9). The tray stack is shown in the carton in phantom in FIG. 9.

Figure 18:
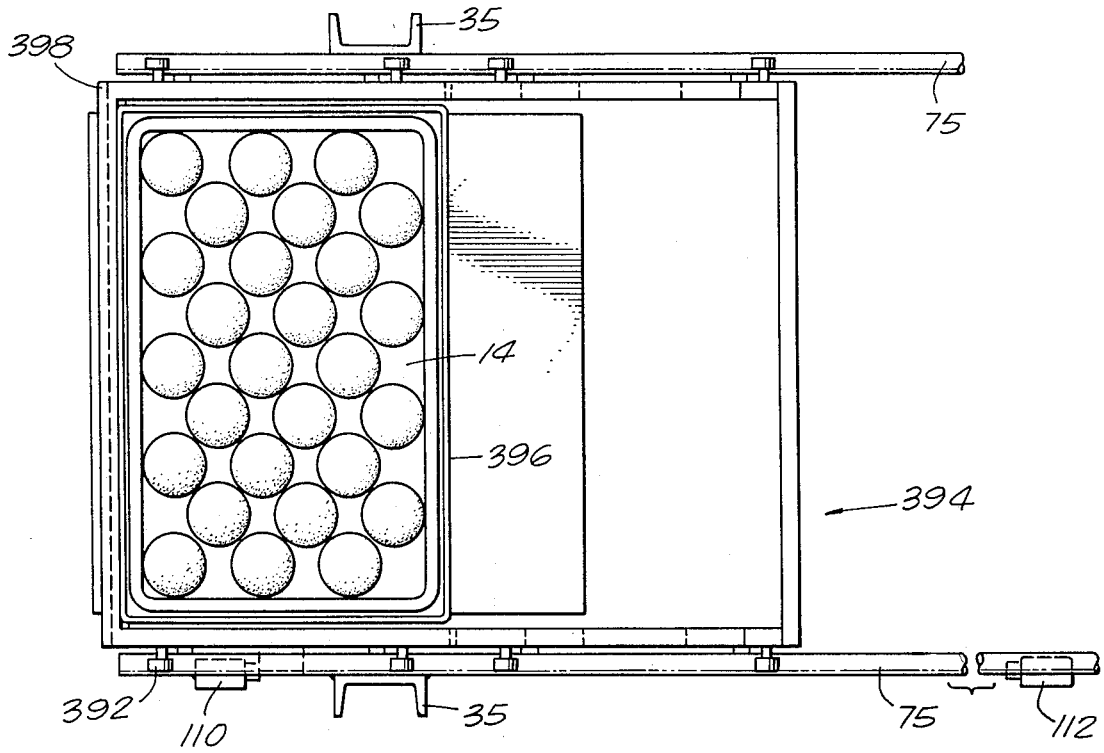
FIG. 18 is a plan view of the boxer mechanism, showing a carton filled with a stack of fruit laden trays.

The boxer assembly 74, as noted in connection with FIG. 1*b*, rides on rails 75 by means of rollers 392. The boxer assembly 74 includes a baling mechanism 394 in combination with the counterweighted drop shelf 390. In opeation, an empty carton 396 (FIGS. 9, 18) is placed about the drop shelf 390 and inside a bale 398 (also shown in FIG. 1*b*). Although the drop shelf 390 and baling mechanism 394 are separately movable on independent frames 400 and 402 and rollers, the two pieces of the boxer assembly 74 are latched together at the abutment of their frames by a latch (not shown), which also prevents the counterweighted drop shelf from rising until the assembly 74 has been placed in position beneath the shelf assembly 26.

At that point the latch on the drop shelf 390 releases, and a counterweight 404, maintained in a housing 406 and connected to a drop shelf support member 408 by means of a chain 410 and pulley 412, causes the drop shelf 390 to rise to the top of its travel, or even with the top of the carton 396. The counterweight 404 preferably has approximately the mass of two fruit laden trays 14, although a wide range of counterweights may be acceptable in certain applications.

When the first shelf 24*a* retracts as described above, the tray stack settles onto the drop shelf 390 and quickly overcomes the inertia of the counterweight 404 and associated components. This permits the tray stack to rapidly but smoothly settle into the carton 396. It is especially important that the tray stack settle smoothly into the carton 396 in view of the speeds at which the apparatus of the present invention operates, since any jerking motion will tend to displace the fruit from the pockets of the trays 14.

Once the tray stack has settled into the carton, the boxer assembly 74 may be returned to its rest position, and the baling mechanism 394 separated from the drop shelf 390. This causes the now filled carton to slide over rails 414, which turns the bottom flaps under sufficiently to permit subsequent handling. Also, a new carton may be supplied to the boxer assembly preparatory to receiving the next tray stack.

Once the boxer assembly 74 is removed from beneath the shelf assembly 26, the "pause" is complete and the incremental belt 12, feed comb 18 and reset arm 28 can be restarted. This results from the rotation of the main cam 56 to a position where the pause follower 292 is disengaged, causing the cam plate 320 to fall below the cam lock follower 326. This permits the cam locks 130 to engage the locking shaft 332 of the secondary cage 126. Also, the fall of the cam plate 302 allows the crescent latch actuator crank 308 to rotate, moving the latch release arm 320 out of the path of the crescent latch 266. A new cycle is thus ready to begin.

Having fully described one embodiment of the present invention, it is to be understood that numerous alternatives and equivalents which do not depart from the present invention will be apparent to those skilled in the art given the teachings herein, and such variations and equivalents are intended to be included within the scope of the present invention.

I claim:

1. Apparatus for automatically packing trays of comestibles having conveyance means for incrementally supplying a plurality of trays shelf means for receiving the trays, said shelf means including a plurality of individually extendable shelves, said shelves having retraction means, feed comb means for transferring the trays from the conveyance means to said shelves of said shelf means alignment means for incrementally moving said shelf means to sequentially align at least some of said plurality of shelves with said conveyance means to receive a tray reset arm means for individually extending at least some of said plurality of shelves to receive a tray, said retraction means on said shelves causing at least some of said shelves to retract as soon as said reset arm means stops causing each of said plurality of shelves to be individually extended, thereby causing the trays to stack, and cycloidal cam means for causing said conveyance means, said feed comb means, said alignment means and said reset arm means to cooperate in synchronism.

2. Apparatus as in claim 1 wherein said conveyance means is adapted to supply a plurality of trays by incrementally advancing.

3. Apparatus as in claim 2 further including boxer means including a counterweighted drop shelf for receiving the stack of trays from said shelf means and depositing the stack of trays in a carton.

4. Apparatus as in claim 1 wherein said shelf means includes a latch for locking at least the bottom one of said shelves into the extended position.

5. Apparatus for packing trays of comestibles having an incremental belt adapted for serially supplying a plurality of trays by incrementally advancing, a shelf assembly including a plurality of individually extendable shelves, each of said shelves including spring-loaded shelf rods to urge said shelves into a retracted position and the lowest one of said shelves having latch means for being locked into the extended position, a feed comb for synchronously transferring the trays from said incremental belt to said shelves of said shelf assembly, alignment means for incrementally lowering said shelf assembly to cause one of said shelves to be aligned with said incremental belt at each increment to receive a tray, reset arm means for individually extending at least some of said shelves to each receive a tray, said lowering of said shelf assembly by said alignment means causing said reset arm means to align with said spring-loaded shelf rods for one of said shelves, all but the lowest one of said shelves being caused to retract by said spring loaded shelf rods as soon as said reset arm means withdraws, thereby causing the trays to form a stack on said latched lowest shelf, and a boxer assembly including a counterweighted drop shelf for receiving the stack of trays from said shelf assembly and depositing the stack of trays in a carton when said latch on said lowest shelf is released.

* * * * *